US006215447B1

(12) United States Patent
Johnson

(10) Patent No.: US 6,215,447 B1
(45) Date of Patent: Apr. 10, 2001

(54) ANTENNA ASSEMBLY FOR COMMUNICATIONS DEVICES

(75) Inventor: Greg Johnson, Aptos, CA (US)

(73) Assignee: RangeStar Wireless, Inc., Aptos, CA (US)

( * ) Notice: Subject to any disclaimer, the term of this patent is extended or adjusted under 35 U.S.C. 154(b) by 0 days.

(21) Appl. No.: 09/374,782

(22) Filed: Aug. 16, 1999

Related U.S. Application Data

(63) Continuation-in-part of application No. 09/008,618, filed on Jan. 16, 1998, now Pat. No. 5,945,954.

(51) Int. Cl.[7] ..... H01Q 1/38
(52) U.S. Cl. ..... 343/702; 348/700 MS
(58) Field of Search ..... 343/702, 770, 343/767; 455/575, 90

(56) References Cited

U.S. PATENT DOCUMENTS

| | | | |
|---|---|---|---|
| 4,443,802 | 4/1984 | Mayes | 343/729 |
| 4,980,694 | 12/1990 | Hines | 343/702 |
| 5,041,838 | 8/1991 | Liimatainen et al. | 343/700 |
| 5,537,123 | 7/1996 | Mandai et al. | 343/700 |
| 5,585,810 | 12/1996 | Tsuru et al. | 343/749 |
| 5,677,698 * | 10/1997 | Snowdon | 343/770 |
| 5,757,333 | 5/1998 | Kitchener | 343/826 |
| 5,831,578 * | 11/1998 | Lefevre | 343/700 MS |
| 5,872,544 | 2/1999 | Schay | 343/727 |
| 5,912,647 | 6/1999 | Tsuru et al. | 343/700 |
| 5,917,450 | 6/1999 | Tsunekawa | 343/700 |
| 5,940,041 | 8/1999 | Koyama et al. | 343/702 |
| 5,969,680 | 10/1999 | Tsuru et al. | 343/700 |

* cited by examiner

*Primary Examiner*—Don Wong
*Assistant Examiner*—James Clinger
(74) *Attorney, Agent, or Firm*—Larkin, Hoffman, Daly & Lindgren, Ltd.; John F. Klos

(57) ABSTRACT

An antenna assembly achieving improved directionality and signal strength using a configured conductive radiator disposed in relationship with the ground plane element of a wireless communication device. The configured conductive radiator includes an elongate slot aperture and surfaces directed toward the ground plane element. The antenna assembly further includes a dielectric element for communicatively coupling the conductive radiator and the ground plane member. Preferably, the dielectric element may be disposed between a portion of the radiator element and the ground plane member, thus forming a compact, directional antenna system.

31 Claims, 8 Drawing Sheets

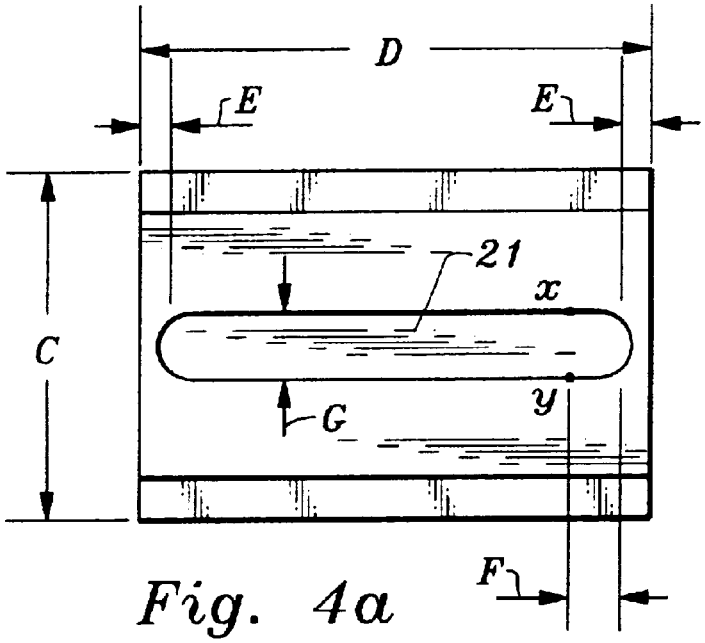
Fig. 4a
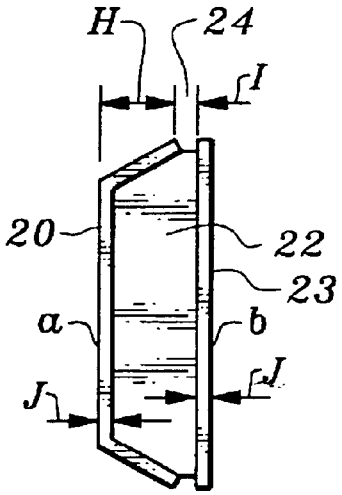
Fig. 4b
| DIMENSION | TYPICAL VALUE FOR 1850–1990 MHZ & $\varepsilon_r$ OF 22 (DIELECTRIC) = 1 |
|---|---|
| C | 1.25" |
| D | 1.70" |
| E | .05" |
| F | .20" |
| G | .20" |
| H | .24" |
| I | .01" |
| J | .015" |
Fig. 4c

ANTENNA ASSEMBLY FOR COMMUNICATIONS DEVICES

This is a continuation-in-part application pursuant to 37 C.F.R. 1.53(b) of application Ser. No. 09/008,618 filed on Jan. 16, 1998, now U.S. Pat. No. 5,945,954.

BACKGROUND OF THE INVENTION

1. Field of Invention

This invention relates to antenna assemblies for hand held radio frequency transmitters or receivers, and more particularly to antenna assemblies for communication devices such as cellular telephones, PCS devices, and the like.

2. Description of the Related Art

Various antennas have been proposed and implemented for radio frequency communication devices such as cellular phones, PCS telephones and the like. Antennas have also been proposed and developed for other applications, for example, U.S. Pat. No. 5,677,698 shows a slot antenna arrangement for portable personal computers. Prior antennas for radio frequency transceivers for telecommunication devices such as cellular telephones and PCS devices have had significant limitations including limited signal range, limited directionality, significant radio frequency radiation output to the user, significant multipath interference, and other related performance limitations.

Accordingly, it is the primary object of this invention to provide an improved antenna for communication devices including hand-held radio frequency transceivers such as cellular phones and PCS devices with improved directionality, broadband input impedance, increased signal strength, and increased battery life. The present invention reduces radio frequency radiation incident to the user's body and reduces the physical size requirements for a directional antenna used on communication devices. Other benefits include a reduction in multipath interference, an increased front-to-back ratio, and improved peak gain. The antenna assembly of the present invention may be integrated into the housing of a cellular transceiver, for example, at the rear portion of a cellular telephone, and is accordingly less susceptible to damage during normal operation.

In general, wireless communication devices, and hand held cellular telephones in particular, use external whip antennas which radiate nominally omnidirectionally. Minimal reduction in transmitted RF energy toward the user's head is provided. As a consequence, typical specific absorption rates (SAR) values of 2.7 mw/g at 0.5 watts input are realized. The external whip antenna is also susceptible to damage and misalignment. Gain of the whip antenna is typically in the range of −5 to +1.5 dBi.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, a multiple element directive antenna assembly for a hand-held radio frequency communication device, such as a cellular telephone or PCS device, is provided. The antenna assembly has a configured active radiating conductor element disposed relative to a conductive ground plane element. A dielectric spacing member may be provided to communicatively couple the active radiating conductor element to the ground plane. The conductive ground plane member may be provided by a printed circuit board or other conductive surface of the hand-held radio frequency transceiver. The multiple-element directive antenna allows for improved directionality and reduced user exposure to radio frequency radiation.

The antenna assembly according to the present invention may be used in wireless communication device such as a cellular telephone or PCS devices where a low physical profile antenna is desired. The antennas of the present invention are particularly suited to receive and radiate electromagnetic energy in the 1850–1990 MHz band. The disclosed antenna offers a rugged, low cost antenna assembly having improved physical parameters while providing superior conformal capability for a handset chassis. Importantly, the overall volume occupied by the present antenna assembly can be held to a minimum. Due to their relative size and conformability, such antenna is preferably housed within an interior portion of the communication device, or on a back chassis surface of the device.

The antenna assembly according to the present invention may operate proximate a ground plane element of a communication device and provide 0–6 dBi gain and 3–18 dB front-to-back directivity, over 2:1 VSWR bandwidths of 8% with linear polarization. Significant improvements include: a reduced overall size relative to known antenna assemblies having similar performance characteristics; the ability to incorporate the antenna within a communication device housing without external appendages; a provision of an interior region within the conductor element and the printed wiring board in which componentry of the communication device may be disposed; and a reduction in the RF energy directed toward a user's head during operation of a hand-held communication device. The present invention provides a substantially smaller and more compact antenna assembly relative to known antenna assemblies having similar gain and directivity characteristics.

BRIEF DESCRIPTION OF THE DRAWINGS

The accompanying drawings, which are incorporated in and constitute a part of the specification, illustrate preferred embodiments of the invention, and together with a general description given above and the detailed description of the preferred embodiment given below, serve to explain the principles of the invention, wherein:

FIGS. 4*a* and 4*b* show plan and elevation views of such antenna, according to the invention;

FIG. 4*c* is a table showing preferred dimensions of such antenna and is designated Table 1, according to the invention;

DESCRIPTION OF THE PREFERRED EMBODIMENTS

Reference will now be made in detail to preferred embodiments of the invention as illustrated in the accompanying drawings.

In accordance with the present invention, an antenna assembly is provided for a radio frequency communication device such as a cellular or PCS telecommunication device. The antenna assembly includes a configured radiating conductor element disposed relative a ground plane member. The ground plane member may be disposed upon a major surface of a dielectric substrate opposite the radiating conductor element, and may consist of the ground plane of the printed circuit board of the communication device or portion thereof, conductive portions of the device chassis or housing, the battery pack of the device, or a separate conductive surface.

Figure 5:
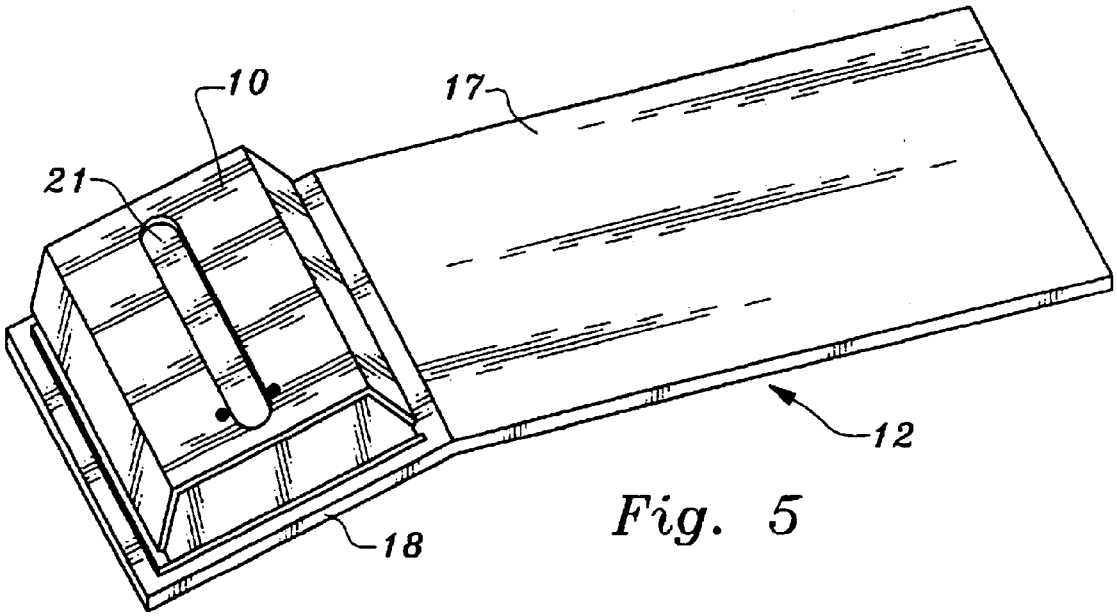
FIG. 5, shows the location of the antenna assembly with respect to the handset ground plane, according to the invention.
Figure 6:
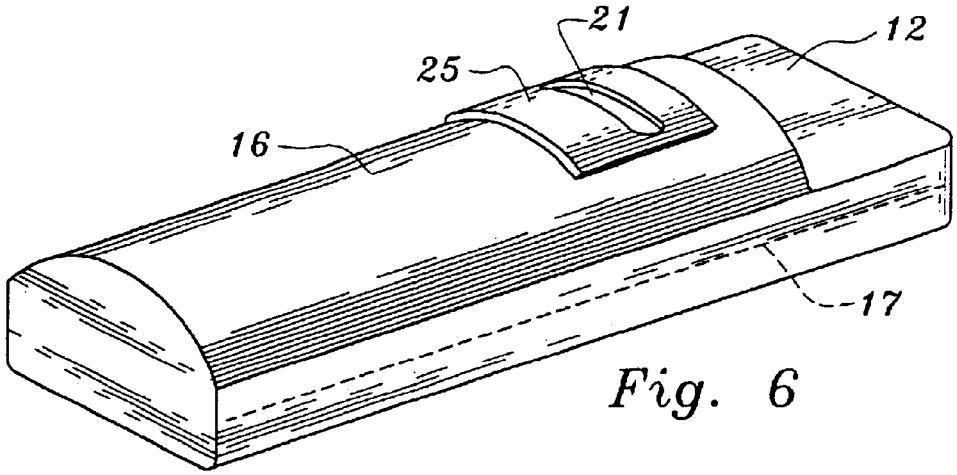
FIG. 6, shows the antenna of the present invention positioned on a rear portion of a cellular handset, according to the invention.

The radiating conductor element of the present invention may includes an elongate slot aperture disposed upon substantially planar surfaces, as in FIGS. 4–5, or a concave surface, as in FIGS. 6–7. The slot aperture may be substantially rectangular in form and extend in a direction which is substantially parallel to the radiating conductor element's axis of concavity. A coaxial feed line may extend generally perpendicularly to the axis of the slot or away from and parallel to the slot. Feed points of the antenna assembly are made at points proximate the slot aperture's periphery.

The radiating conductor element is constructed of a conducting material and is disposed upon a top surface of a dielectric substrate member. The radiating conductor element, dielectric substrate member, and a ground plane member are positioned in generally overlapping or "laminated" relationship to each other. The spacing or relative position between the radiating conductor and the ground plane is an important parameter to the antenna assembly's electrical performance. The ground plane may be capacitively or directly coupled to a conductive ground plane of the radio frequency transceiver device to obtain the desired performance benefits. Coupling to the inherent transceiver ground plane in this fashion allows the improvements in electrical performance to be achieved more independently of transceiver design.

Figure 1:
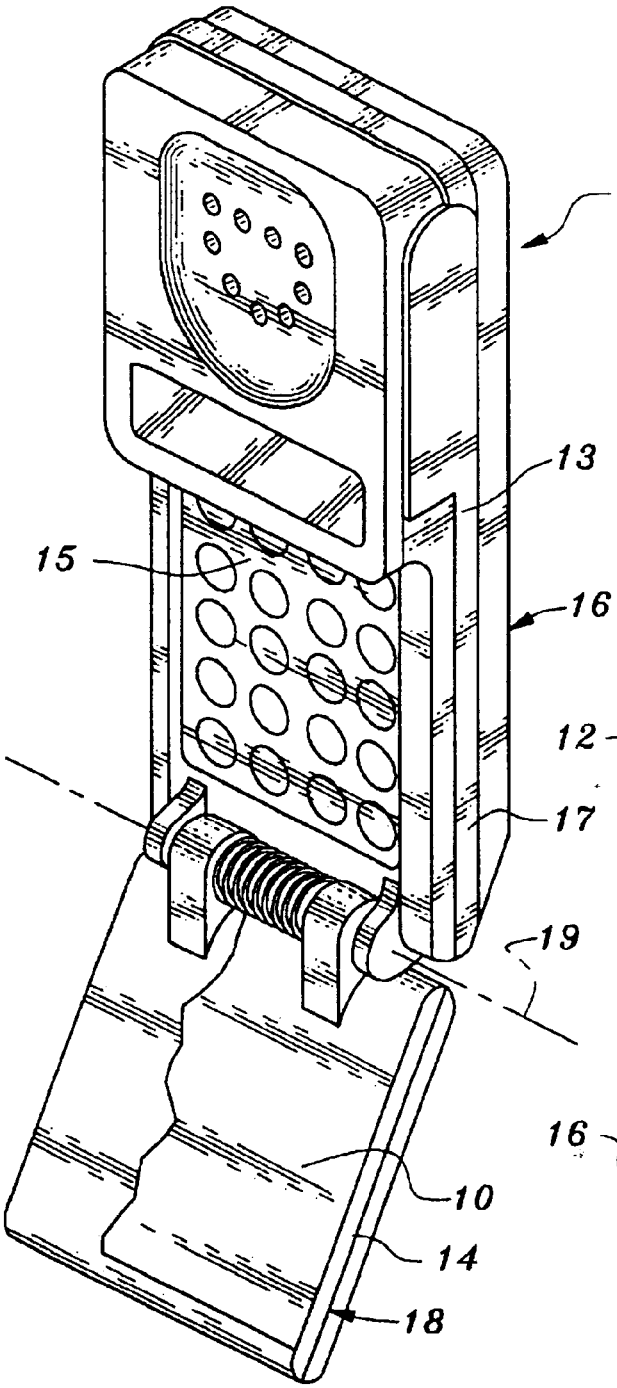
FIG. 1 is a perspective view of a telephone hand-set with the directional antenna of the present invention positioned in a lower hinged panel, according to the invention.
Figure 2:
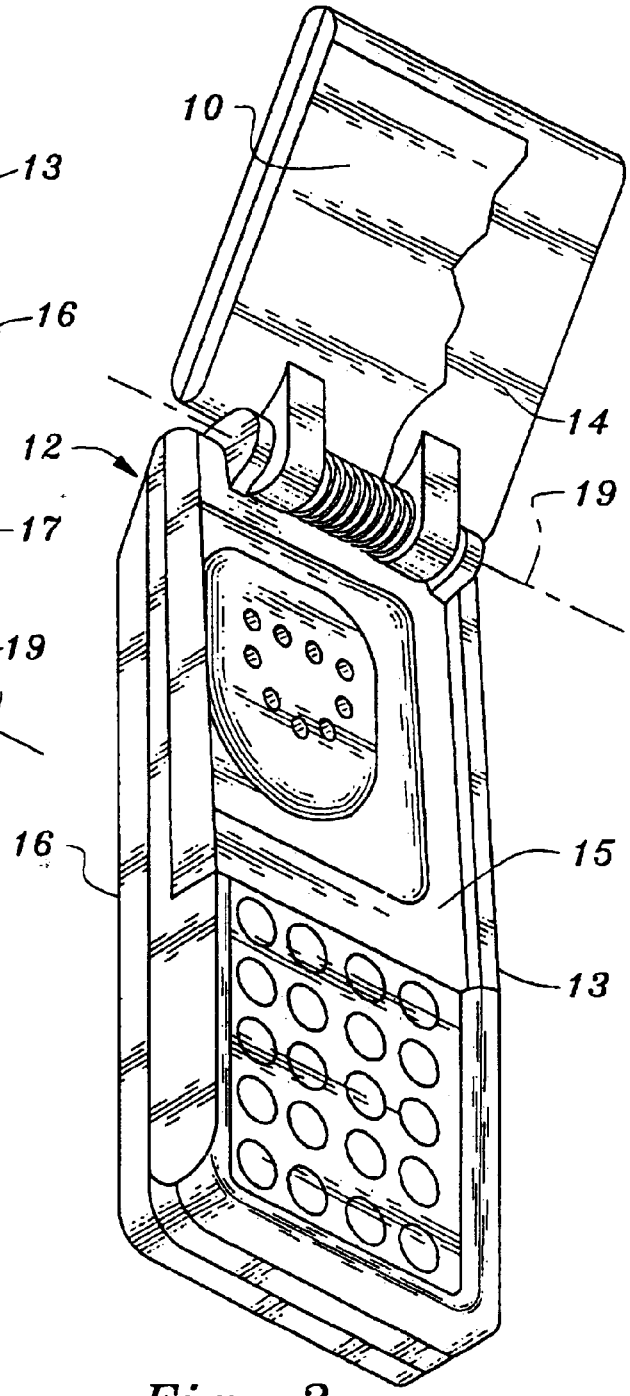
FIG. 2 is a perspective view of a telephone hand-set with the directional antenna of the present invention positioned in an upper hinged panel, according to the invention.

FIGS. 1 and 2 illustrate the antenna assembly 10 for a communication device according to a preferred embodiment of the invention on a hand held cellular telephone handset 12. In FIG. 1 the antenna assembly is disposed within a lower hinged "flip" or, panel portion. In FIG. 2, the antenna assembly is disposed on the outside portion of upper hinged "flip" or panel portion. The handset includes a main body portion 13 and a hinged "flip" or panel portion 14, which in FIGS. 1 and 2 is shown in its opened, operational position. Telephone handset 12 preferably includes a front side 15 having a speaker and microphone (not shown) and a rear side 16. The existing conducting ground plane 17 in handset 12 is electrically connected to a conducting ground plane 18 located within the flip portion 14. This may be accomplished by a hinge 19 or the like. The antenna assembly 10 and the ground plane extension 18 are preferably concealed or encased in the handset 12. Antenna assembly 10 is preferably formed by a planar or concave radiating conductor element generally separated from a larger ground plane by a dielectric material. The dielectric material may be, for example, the case of a cellphone. The ground plane may be the inherent ground plane in a cellphone.

Figure 3:
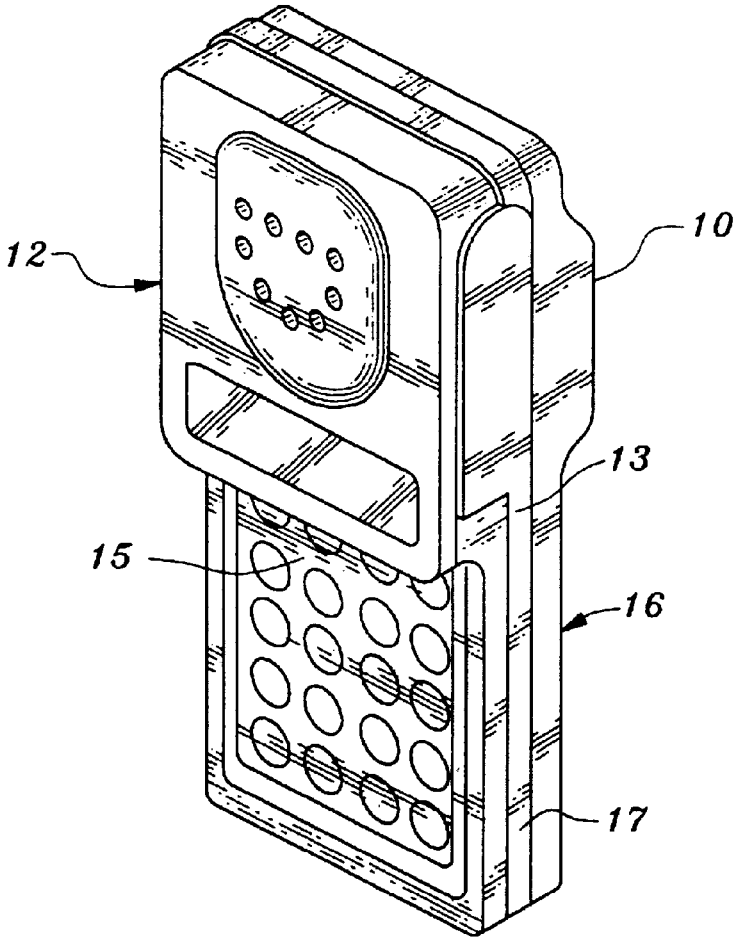
FIG. 3 illustrates a cellular handset with such antenna positioned on the rear top thereof, according to the invention.

With reference now to FIG. 3, cellular telephone handset 12 and antenna assembly 10 are shown with antenna assembly 10 concealed or encased in the housing of the transceiver. The antenna location shown is preferred so as to minimize the potential for contact by the user's hand. Antenna assembly 10 may also be used with other types of communication devices such as PCS devices, LAN apparatuses, and the like.

Referring now to FIGS. 4*a* and 4*b*, antenna assembly 10 is shown in plan and elevation view with antenna assembly 10 having transmission side (a) and opposite side (b). Placement of the antenna assembly 10 on the transceiver device 12 is such that during operation the transmission side (a) is generally directed away from the user. Antenna assembly 10 preferably includes a radiating conductor element 20 with slot 21, preferably rectangularly configured, a dielectric substrate 22, and a conducting ground plane member 23. A low impedance coax feed line may be connected along the edges of slot 21 at points x and y. The shape and size of the radiating conductor 20, slot 21, location of feed line connection points x and y, and the spacing 24 to the ground plane 23 are critical to operation of antenna assembly 10. In FIG. 4*c*, Table 1 lists dimensions and typical values for 1850–1190 MHz range. The dielectric 22 and ground plane 23 may extend beyond the edges of radiating conductor 20. The dielectric material may have a dielectric constant of one or greater. Antenna assembly elements 20, 22, and 23 may be positioned in a laminar fashion and glued or otherwise secured together.

As seen in FIG. 5, antenna assembly 10 may be positioned on or above the ground plane 17 that exists within the communication device 12 or the extension thereof 18 in flip portion 14. This is illustrated without the handset present. The separation of ground planes 17 and 23 is generally not critical, however, it provides sufficient capacitive or direct (dc) coupling over the frequency band(s) of interest, and may be filled with a dielectric material of relative dielectric constant one or greater. The polarization of the antenna assembly 10 is linear, and in a direction at 90 degrees to slot 21 and parallel to the plane containing slot 21.

Antenna assembly 10 may be formed as a C-shaped radiating conductor element critically spaced from a ground plane of a similar projected area by a dielectric spacer. Radiating conductor element 20 preferably has a slot fed through low impedance coax. The ground plane 23 is coupled directly or capacitively to a larger ground plane, for example, the inherent ground plane of a cellphone.

Figure 7A:
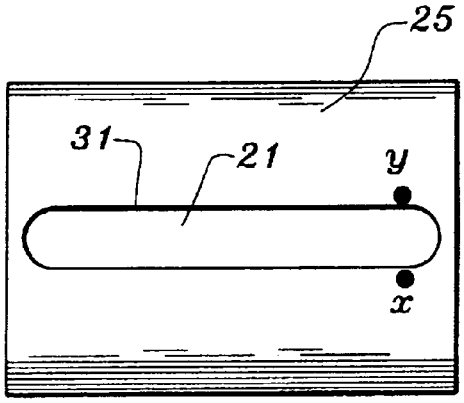
FIGS. 7A and 7B show front and elevational views of the antenna of the present invention positioned on a rear portion of a cellular handset, according to the invention.
Figure 7B:
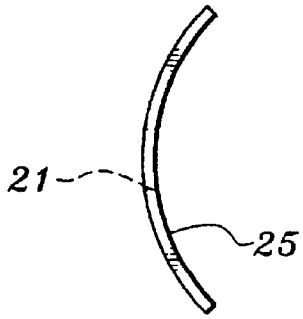

In FIG. 6, cellular telephone handset 12 and an antenna are shown with antenna 25 mounted directly to the dielectric material on the rear 16 of handset 12, which may be a battery pack. The general location shown is preferred, so as to minimize potential contact with the user's hand during operation. Antenna 25 may be incorporated into the plastic of the battery pack or that of the handset. In one embodiment of the invention, as seen in FIGS. 7*a* and 7*b*, antenna 25 comprises a radiating conductive element only. Previously discussed dimensions and design considerations discussed with reference to antenna assembly 10 apply to this embodiment of the antenna as well.

Figure 8A:
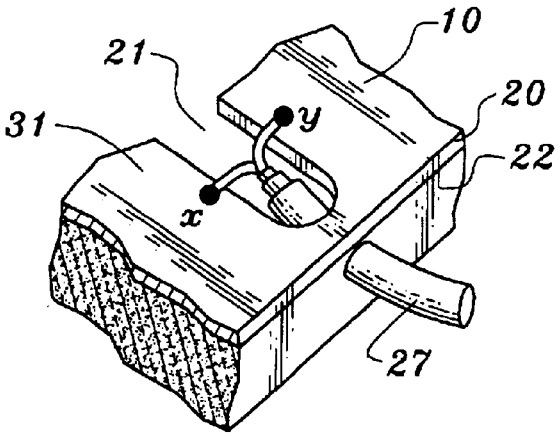
FIGS. 8*a* and 8*b* show preferred routings of a coax feed line from the radiating conductor element, according to the invention.
Figure 8B:
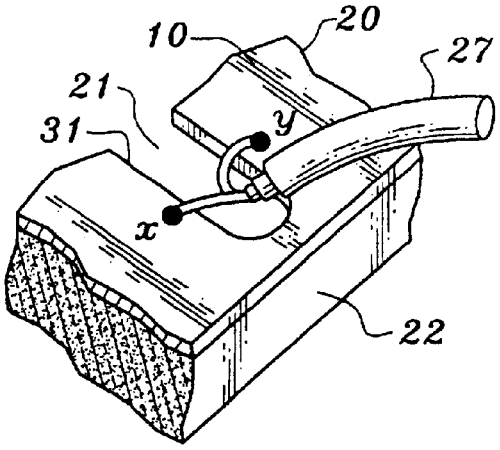
Figure 9:
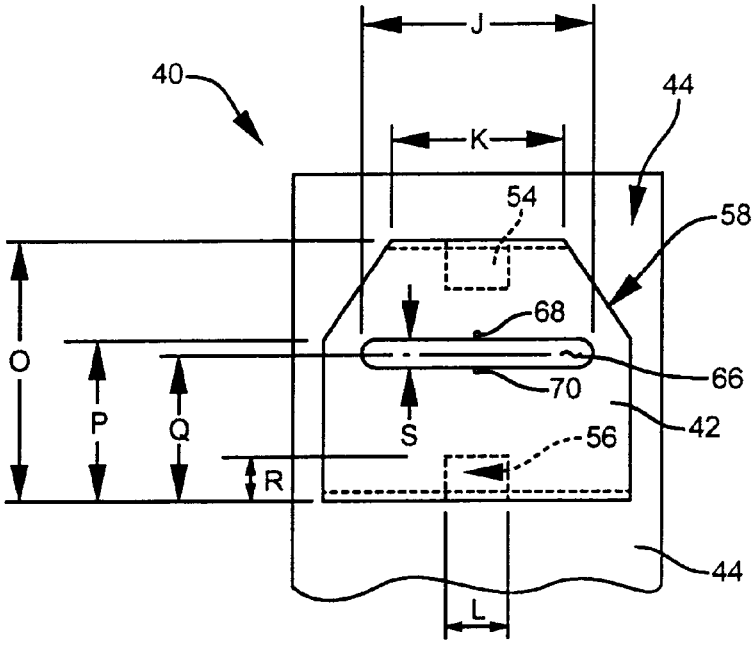
FIG. 9 illustrates a top plan view of another embodiment of an antenna assembly according to the present invention.

Referring now to FIGS. 8*a* and 8*b,* a preferred routing or location of coax feed line 27 from antenna assembly 10 or antenna 25 is shown. Preferably coax leads x and y are connected to periphery 31 of slot 21 by soldering. The inclusion of the cellphone's inherent ground plane, which is generally rectangular in shape, into the antenna assembly 10 results in increased gain over that expected from a conventional slot antenna.

Figure 10:
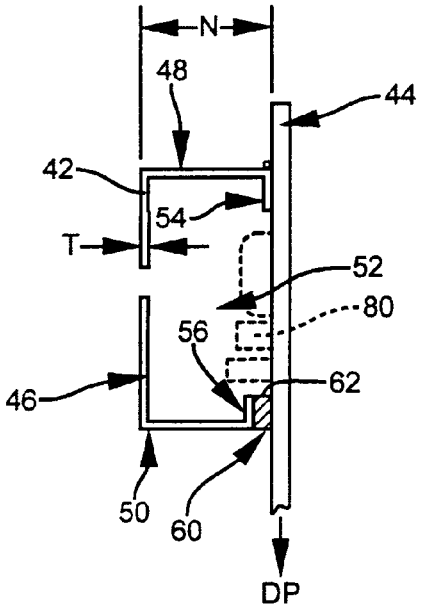
FIG. 10 illustrates a right side elevational view of FIG. 9.
Figure 11:
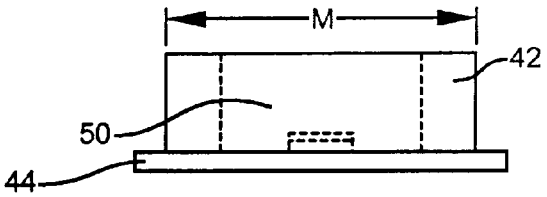
FIG. 11 illustrates a bottom side elevational view of FIG. 9.
Figure 12:
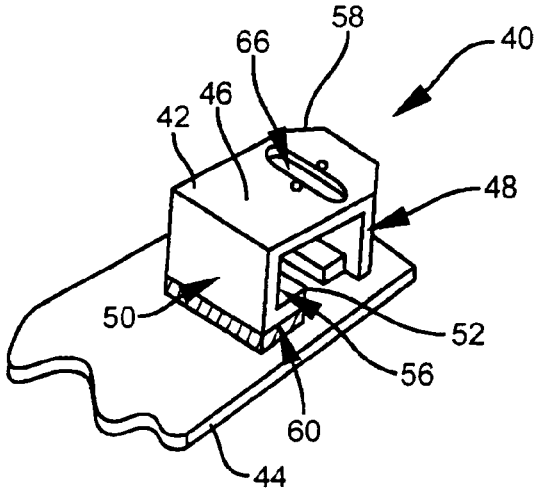
FIG. 12 illustrates a perspective view of the antenna assembly of FIGS. 9–11.

FIGS. 9–17 disclose other preferred embodiments of the present invention. Referring particularly to FIGS. 9–13, an antenna assembly 40 includes a conductor element 42 disposed relative to a ground plane 44 element of a wireless communication device. Ground plane element 44 may be defined as a portion of the printed wiring board (PWB) of the communication device. The conductor element 42 includes first, second, and third conductive surfaces 46, 48, 50, and may be a single formed metallic element. The conductor element 42 is approximately "C" shaped when viewed from its side, as illustrated in FIG. 10, and defines an interior region 52 disposed between the conductor 42 and the ground plane element 44. Components of the communication device 80 may be disposed within the interior region 52 to effect a reduction in overall volume of the device.

The first conduction surface 46 is disposed a predetermined distance above the ground plane element 44, and is electrically coupled to a downwardly-directed, perpendicular second conduction surface 48, which is shorted to the ground plane 44 at end mounting tab 54. One or more mounting tabs 54 may be practicable to provide for stability of conductor 42 or routing requirements of the printed wiring board of the communication device.

First conduction surface 46 is also coupled to a downwardly-directed perpendicular third conduction surface 50. Third conduction surface 50 includes a perpendicular plate section 56 for capacitively coupling conductor 42 to the ground plane member 44. One or more perpendicular plate sections 56 may be practicable to provide for conductor stability or wire routing requirements of the printed circuit board of the communication device. Ground plane element 44 has a minimum length in a direction of polarization 'DP' of approximately one-quarter wavelength (for a wavelength within the range of operation). Second and third conduction surfaces 48, 50 extend from opposed edges of conduction surface 46. Conductor element 42 may be a single metallic formed element having a thickness within the range of 0.005 to 0.09 inch.

Still referring to FIGS. 9–13, first conduction surface 46 includes removed angled corner portions 58 for minimizing the overall volume occupied by the antenna assembly 40. Other shapes or configurations (or entire deletion) of the removed portions 58 may be practicable. The antenna assembly 40 may be disposed within the communication device at the rear panel and proximate the upper portion of the handset (away from a user's hand), as illustrated in the embodiment of FIGS. 3 and 5.

Figure 13:
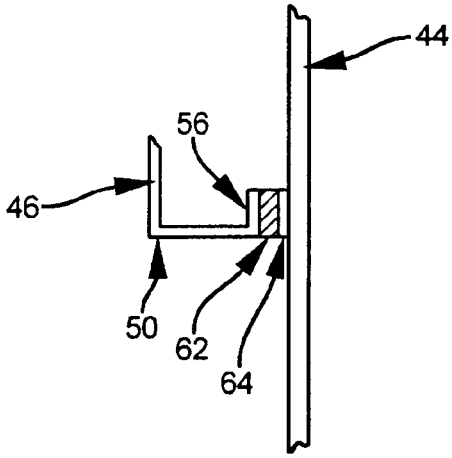
FIG. 13 illustrates a detailed view of another embodiment of an antenna assembly according to the present invention.

Conductor element 42 defines one side or plate of a two plate capacitor 60. Plate element 56 is spaced away from the ground plane element 44 by a dielectric element 62 so as to form a capacitor. Dielectric element 62 may have a dielectric constant of 0–10. FIG. 13 illustrates another embodiment of the capacitor 60 wherein a second plate element 64 is disposed upon the surface of the printed wiring board substrate and operatively coupled to the ground plane element 44.

Figure 14:
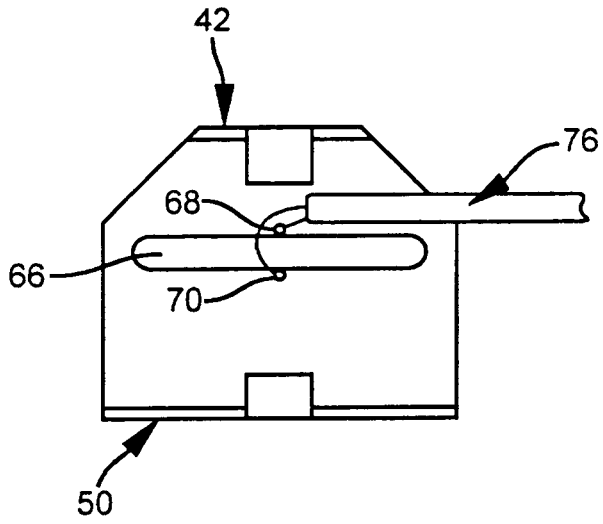
FIG. 14 is a bottom plan view of another embodiment of an antenna assembly according to the present invention and illustrates one preferred feed configuration.
Figure 15:
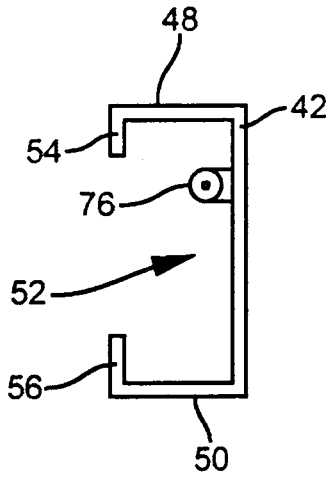
FIG. 15 is a right side elevational view of FIG. 14.
Figure 16:
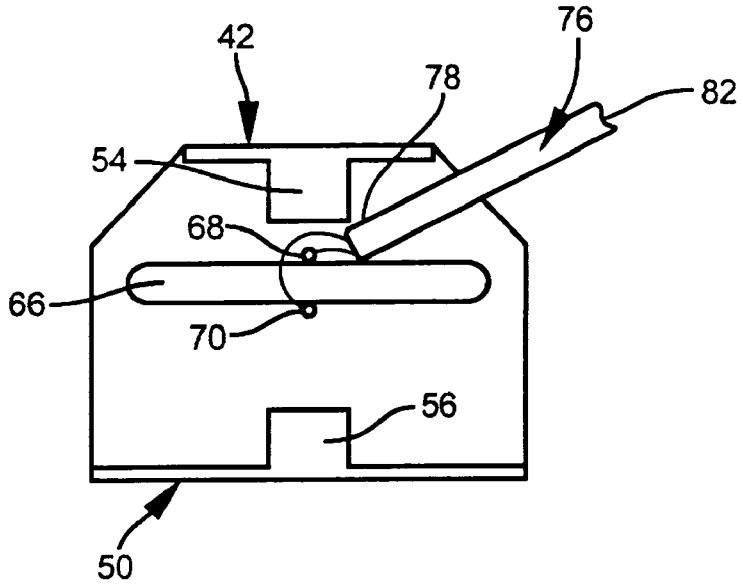
FIG. 16 is a bottom plan view of another embodiment of an antenna assembly according to the present invention and illustrates another preferred feed configuration.
Figure 17:
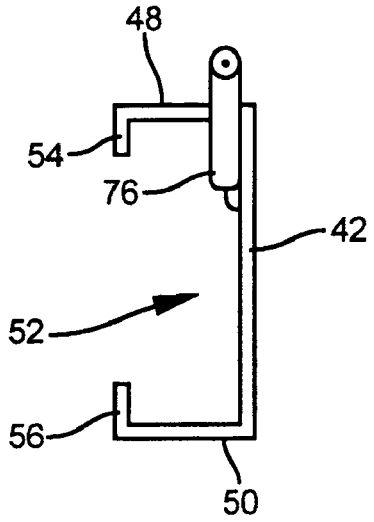
FIG. 17 is a right side elevational view of FIG. 16.

Conductor element 42 further includes an elongate slot element 66 defined within the conduction surface 46. When viewed as in FIG. 9, slot 66 laterally extends within the boundary of the conduction surface 46 and is approximately aligned with the conduction surfaces 48 and 50. Slot element 66 defines two feed points 68, 70 for electrically coupling the conductor element 42 to the communication device via coax feed line 76. Feed points 68, 70 are disposed along the lateral centerline of the slot element 66. FIGS. 14–17 illustrate alternative feed line orientations relative to the conductor section 42. In FIGS. 14–15, the feed line 76 is disposed within the interior region 52 of the conductor element 42 and approximately aligned with a longitudinal direction of the slot 66. In FIGS. 16–17, the feed line 76 is disposed within the interior region 52 of the conductor element 42 and obliquely aligned relative to the slot 66. The coax feed line 76 may be a 50 ohm coaxial line having an outer shield conductor 78 coupled to the slot element 66 at feed point 68, and an inner conductor 82 coupled at opposite feed point 70.

Particular dimensions of one preferred embodiment according to the present invention are included as Table 2.

TABLE 2

| Dimension | Inch |
|---|---|
| j | 1.10 |
| k | .75 |
| l | .3 |
| m | 1.25 |
| n | .47 |
| o | .91 |
| p | .80 |
| q | .57 |
| r | .20 |
| s | .18 |
| t | .015 |

In operation and use the antenna assembly is extremely efficient and effective. The antenna assembly of the present invention provides improved directivity, broadband input impedance, increased signal strength, and increased battery life. The antenna of the present invention reduces radio frequency radiation incident to the user's body, and reduces the physical size requirements of directional antenna used in cell phone handsets, PCS devices and the like. The disclosed antenna also increases front-to-back ratios, reduces multipath interference, and is easily integrated into the "flip" or rear panel portion of a cellular transceiver device, which minimizes the risk of damage or interference.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

I claim:

1. An antenna assembly for a radio-frequency communication device having an electronic component, said antenna assembly comprising:

a conductor element having a plurality of surfaces including a central surface and a first surface and a second surface together defining an interior region said central surface having a feedpoint for coupling to the electronic component;

a conductive ground plane member spaced a distance away from the conductor element in a first direction, said conductive ground plane member operatively coupled to the electronic component, and said first surface of the conductor element being operatively coupled to the ground plane member; and a capacitor element operatively coupling the second surface of the conductor element and the conductive ground plane member.

2. An antenna assembly for a radio-frequency communication device according to claim 1, wherein the plurality of surfaces includes a central planar portion and a pair of planar leg portions.

3. An antenna assembly for a radio-frequency communication device according to claim 2, wherein the central portion of the conductor element is substantially parallel to the ground plane member.

4. An antenna assembly for a radio-frequency communication device according to claim 1, wherein the feedpoint is defined at a point along an elongate aperture which is disposed within the central portion.

5. An antenna assembly for a radio-frequency communication device according to claim 1, wherein the ground plane member is a conductive panel member separate from a ground plane of the electronic component.

6. An antenna assembly for a radio-frequency communication device having an electronic component, said antenna assembly comprising:

a conductor element defining a central portion and a pair of leg portions, said conductor element having an elongate aperture disposed between the pair of leg portions, said conductor element operatively coupled to the electronic component proximate the elongate aperture, said pair of leg portions extending in a first direction away from the central portion;

a conductive ground plane member spaced a distance away from the conductor element in the first direction, said pair of leg portions extending toward said conductive ground plane member, said conductive ground plane member operatively coupled to the electronic component; and a dielectric member, at least a portion of said dielectric member positioned between the conductor element and the conductive ground plane member.

7. An antenna assembly for a radio-frequency communication device according to claim 6, wherein the central portion of the conductor element is rectangular and substantially planar.

8. An antenna assembly for a radio-frequency communication device according to claim 6, wherein at least a portion of the dielectric member is in contact with the conductor element.

9. An antenna assembly for a radio-frequency communication device according to claim 6, wherein said portion of the dielectric member is disposed between one of said pair of leg members and the ground plane element to capacitively couple the conductor element to the ground plane element.

10. An antenna assembly for a hand-held radio-frequency communication device having an electronic component said antenna assembly comprising:

a concave conductor element defining an interior region and having an elongate aperture disposed thereon, said concave conductor element operatively coupled to the electronic component, said concave conductor element having a direction of concavity;

a conductive ground plane member spaced a distance away from the concave conductor element in the direction of concavity, said conductive ground plane member operatively coupled to the electronic component; and a dielectric member, at least a portion of said dielectric member being disposed between the concave conductor element and the conductive ground plane member.

11. An antenna assembly for a hand-held radio-frequency communication device according to claim 10, wherein at least a portion of the dielectric member is in contact with the concave conductor element.

12. An antenna assembly for a hand-held radio-frequency communication device according to claim 10, wherein the concave conductor element is rectangular.

13. An antenna assembly for a hand-held radio-frequency communication device according to claim 10, wherein the ground plane member is a conductive panel member separate from a ground plane of the electronic component.

14. An antenna assembly for a radio-frequency communication device having an electronic component, said antenna assembly comprising:

a conductor element defining a central portion and a first leg portion and a second leg portion, said conductor element having an elongate aperture disposed upon the central portion between the first and second leg portions, said conductor element operatively coupled to the electronic component proximate the elongate aperture, said first and second leg portions extending in a first direction away from the central portion;

a conductive ground plane member spaced a distance away from the conductor element in the first direction, said first and second leg portions extending toward said conductive ground plane member, said conductive ground plane member operatively coupled to the electric component and the first leg portion; and a dielectric member, at least a portion of said dielectric member disposed between the conductor element and the conductive ground plane member.

15. An antenna assembly for a hand-held radio-frequency communication device according to claim 14, wherein the portion of the dielectric member is disposed between the second leg portion and the ground plane member.

16. An antenna assembly for a hand-held radio-frequency communication device having an electronic component including a printed circuit board and a ground plane, said antenna assembly comprising:

a configured radiator element having a central surface, a first conductor surface, and a second conductor surface, said configured radiator element defining an interior region between the first conductor surface and the second conductor surface, both first and second conductor surfaces extending in a first direction directed toward the ground plane of the electronic component, said configured radiator element having an elongate aperture disposed thereupon; and a capacitor element operatively coupling the configured radiator element to the ground plane of the electronic component.

17. An antenna assembly according to claim 16, wherein the first conductor surface is operatively coupled to the ground plane member.

18. An antenna assembly according to claim 16, wherein the capacitor element is disposed between the second conductor surface and the printed circuit board.

19. An antenna assembly according to claim 16, wherein the configured radiator element is posed within a housing of the communication device, proximate an upper portion thereof.

20. A method of providing a compact antenna assembly for a radio-frequency communication device having an electronic component including a printed circuit board and a ground plane, said method comprising the steps of:

providing a configured radiator element having a central surface, a first conductor surface, and a second conductor surface, said configured radiator element defining an interior region between the first conductor surface and the second conductor surface, both first and second conductor surfaces extending in a first direction directed toward the ground plane of the electronic component, said configured radiator element havinig a feedpoint defined within the central surface for coupling to the electronic component; and providing a capacitor element operatively coupling the configured radiator element to the ground plane of the electronic component.

21. The method of claim 20, wherein the configured radiator element further includes an elongate slot aperture defined upon the central surface, and the feedpoint is defined at a point along the elongate slot aperture.

22. The method of claim 20, wherein the capacitor element is disposed between the second conductor surface and the ground plane of the communication device.

23. The method of claim 20, wherein the first conductor surface is operatively coupled to the ground plane of the communication device.

24. The method of claim 20, wherein the central surface, first conductor surface, and second conductor surface are each substantially planar surfaces.

25. An antenna assembly for a wireless communication device for receiving and transmitting a communication signal, said antenna assembly comprising:

a ground plane element disposed within the wireless communication device;

a feedline conductor defining a signal transmission output; and a radiating conductor element having a first surface and a second surface and an intermediate surface disposed away from the ground plane element, said conductor element defining an interior region between said first surface and said second surface, said first surface operatively coupled to the ground plane element, said second surface capacitively coupled to the ground plane element, and said intermediate surface operatively coupled to the feedline conductor at a feedpoint.

26. An antenna assembly according to claim 25, wherein the radiating conductor element includes a plurality of surfaces, including at least a first conducting surface, a second conducting surface, and a third conducting surface.

27. An antenna assembly of claim 26, wherein the plurality of conducting surface are each substantially planar.

28. An antenna assembly of claim 27, wherein the first conducting surface is substantially perpendicular to both the second conducting surface and the third conducting surface.

29. An antenna assembly of claim 28, wherein the third conducting surface is coupled to a plate section, said plate section defining a portion of the capacitive coupling of the radiating conductive element.

30. An antenna assembly of claim 28, wherein the feedpoint is defined along an elongate slot aperture of the radiating conductor element.

31. An antenna assembly of claim 25, wherein the ground plane element is defined upon a printed wiring board of the wireless communication device.

* * * * *